US010864408B2

(12) United States Patent
Sajima et al.

(10) Patent No.: US 10,864,408 B2
(45) **Date of Patent: *Dec. 15, 2020**

(54) GOLF BALL

(71) Applicant: SUMITOMO RUBBER INDUSTRIES, LTD., Kobe (JP)

(72) Inventors: Takahiro Sajima, Kobe (JP); Hironori Takihara, Kobe (JP); Toshiyuki Takubo, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/265,583

(22) Filed: Feb. 1, 2019

(65) Prior Publication Data

US 2019/0269974 A1 Sep. 5, 2019

(30) Foreign Application Priority Data

Mar. 1, 2018 (JP) ..... 2018-036559

(51) Int. Cl.

| | |
|---|---|
| ***A63B 37/06*** | (2006.01) |
| ***A63B 37/00*** | (2006.01) |
| *A63B 102/32* | (2015.01) |

(52) U.S. Cl.

CPC ..... *A63B 37/0005* (2013.01); *A63B 37/002* (2013.01); *A63B 37/0004* (2013.01); *A63B 37/0012* (2013.01); *A63B 37/0015* (2013.01); *A63B 37/0019* (2013.01); *A63B 37/0021* (2013.01); *A63B 37/0022* (2013.01); *A63B 37/0096* (2013.01); *A63B 37/0074* (2013.01); *A63B 2102/32* (2015.10)

(58) Field of Classification Search

CPC ..... A63B 37/0005; A63B 37/0004
USPC ..... 473/378
See application file for complete search history.

(56) References Cited

U.S. PATENT DOCUMENTS

| | | | | |
|---|---|---|---|---|
| 2011/0077106 | A1 | 3/2011 | Fitchett | |
| 2015/0182805 | A1 | 7/2015 | Sajima et al. | |
| 2018/0056136 | A1* | 3/2018 | Mimura | A63B 37/0005 |
| 2018/0056138 | A1* | 3/2018 | Sajima | A63B 37/0075 |
| 2019/0269975 | A1* | 9/2019 | Sajima | A63B 37/0005 |
| 2019/0269979 | A1* | 9/2019 | Sajima | A63B 37/0005 |

FOREIGN PATENT DOCUMENTS

| | | | |
|---|---|---|---|
| JP | H02-68077 | A | 3/1990 |
| JP | 2011-72776 | A | 4/2011 |
| JP | 2015-142599 | A | 8/2015 |

* cited by examiner

*Primary Examiner* — Raeann Gorden
(74) *Attorney, Agent, or Firm* — Birch, Stewart, Kolasch & Birch, LLP

(57) ABSTRACT

A golf ball has a plurality of dimples 12 and a land 14 on a surface thereof. The golf ball further has a large number of minute projections 18 formed on surfaces of the dimples 12 and the land 14. The minute projections 18 are exposed on the surface of the golf ball. The surface of the golf ball has an arithmetic average height Sa of not less than 0.5 μm and not greater than 30 μm. The surface of the golf ball has a maximum height Sz of not less than 5 μm and not greater than 200 μm.

7 Claims, 7 Drawing Sheets

GOLF BALL

This application claims priority on Patent Application No. 2018-036559 filed in JAPAN on Mar. 1, 2018. The entire contents of this Japanese Patent Application are hereby incorporated by reference.

BACKGROUND OF THE INVENTION

Field of the Invention

The present invention relates to golf balls. Specifically, the present invention relates to golf balls each having minute projections on the surface thereof.

Description of the Related Art

A golf ball that is hit with a golf club flies in the air. The golf ball falls and rolls on the ground. When the golf ball falls and when the golf ball rolls, the golf ball comes into contact with the ground. Due to the contact, mud may adhere to the surface of the golf ball and the surface of the golf ball may become stained. When a golf ball is on the fairway or rough, a golf player is not allowed to touch the golf ball. Therefore, the golf player cannot remove dirt from the golf ball. On the green, the golf player can remove dirt from the golf ball. However, work for the removal takes time and effort. Dirt cannot be sufficiently removed by work in some cases. Dirt cannot be removed by washing with water in some cases. The golf ball on which dirt remains is exchanged. The exchange puts an economic burden on the golf player.

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backward leading to a reduction of drag. The turbulization promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the air flow. The excellent dimples produce a long flight distance.

The rate of backspin correlates with a trajectory height. With a golf ball having a high backspin rate, a large trajectory height is obtained. Upon a shot with a long iron, the trajectory height tends to be low. Golf players desire golf balls having a high spin rate upon a shot with a long iron.

JP2015-142599 discloses a golf ball having a surface with large roughness. The roughness can be formed by blasting or the like. The roughness enhances the aerodynamic characteristic of the golf ball due to a synergetic effect with dimples.

JP2011-72776 discloses a golf ball having a coating formed from a paint that contains particles. The particles enhance the aerodynamic characteristic of the golf ball due to a synergetic effect with dimples.

JPH2-68077 discloses a golf ball having dimples each having one projection at a bottom thereof. The dimples each having the projection enhance the aerodynamic characteristic of the golf ball.

An object of the present invention is to provide a golf ball having a sufficiently high spin rate upon a shot with a long iron and having excellent stain resistance and washability.

SUMMARY OF THE INVENTION

A golf ball according to the present invention has a core and a cover positioned outside the core. The cover has a plurality of minute projections on a surface thereof. Each minute projection has an exposed portion that is exposed on a surface of the golf ball. The surface of the golf ball has an arithmetic average height Sa of not less than 0.5 μm and not greater than 30 μm. An average value Hav of heights H of the exposed portions is not less than 0.5 μm and not greater than 50 μm.

In the golf ball according to the present invention, the exposed portions reduce the lift force of the golf ball during flight. A trajectory of the golf ball is not excessively high. Therefore, with the golf ball, a large flight distance is achieved upon a shot with a long iron.

Preferably, a ratio Pp of a sum of areas of all the exposed portions to a surface area of a phantom sphere of the golf ball is not less than 7%.

Preferably, an average value Dav of diameters D of the exposed portions is not less than 5 μm and not greater than 50 μm.

Preferably, an average value Pav of pitches P each between an exposed portion and another exposed portion adjacent to this exposed portion is not greater than 100 μm.

Preferably, the surface of the golf ball has a maximum height Sz of not less than 5 μm and not greater than 200 μm.

The golf ball may further have a paint layer partially covering the cover. The exposed portions project from the paint layer.

DESCRIPTION OF THE PREFERRED EMBODIMENTS

The following will describe in detail the present invention based on preferred embodiments with appropriate reference to the drawings.

Figure 1:
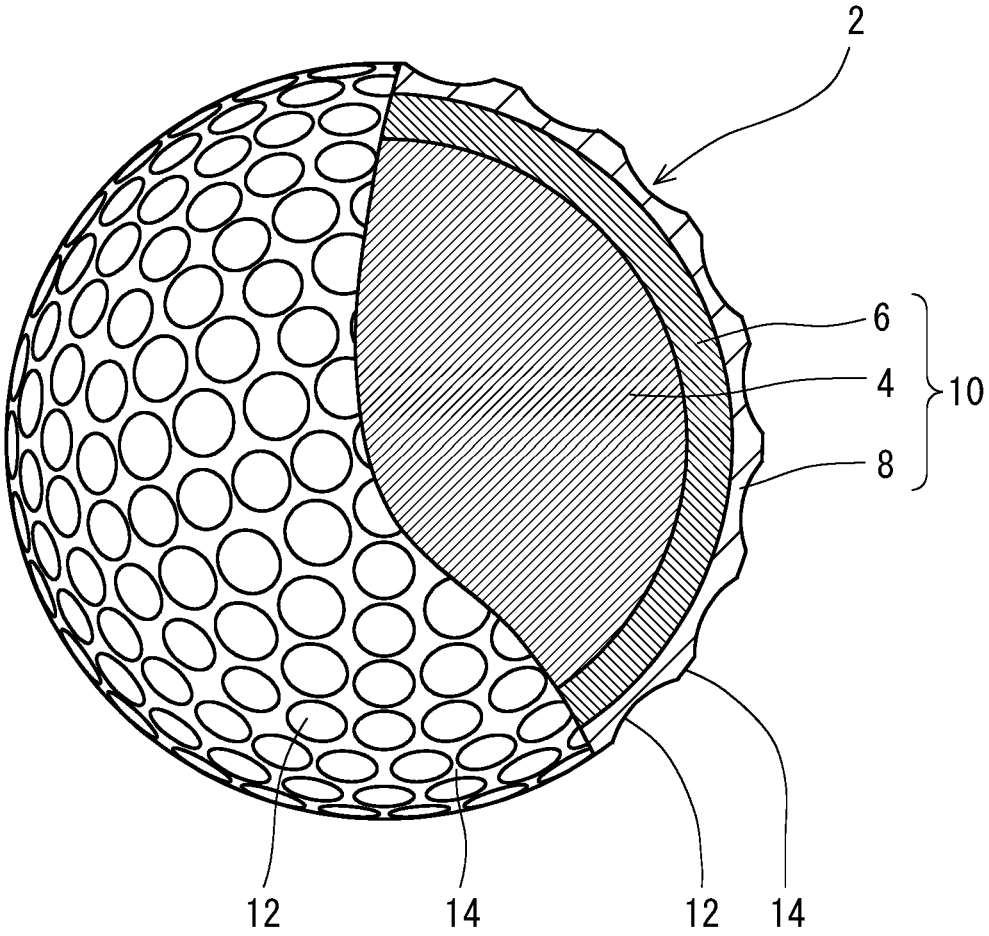
FIG. 1 is a cross-sectional view of a golf ball according to an embodiment of the present invention.

A golf ball 2 shown in FIG. 1 includes a spherical core 4, a mid layer 6 positioned outside the core 4, and a cover 8 positioned outside the mid layer 6. The core 4, the mid layer 6, and the cover 8 are included in a main body 10 of the golf ball 2. The golf ball 2 does not have a paint layer. The golf ball 2 has a large number of dimples 12 on the surface thereof. Of the surface of the golf ball 2, a part other than the dimples 12 is a land 14. The main body 10 may have a one-piece structure, a two-piece structure, a four-piece structure, a five-piece structure, or the like.

The golf ball 2 preferably has a diameter of not less than 40 mm and not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The diameter of the golf ball 2 according to the present embodiment is 42.7 mm.

The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

Preferably, the core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The core 4 may be formed from a resin composition. The core 4 may be formed from a mixture of a rubber composition and a resin composition. A resin composition that will be described later for the mid layer 6 or the cover 8 can be used for the core 4.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or cross-linked rubber powder.

The core 4 has a diameter of preferably not less than 30.0 mm and particularly preferably not less than 38.0 mm. The diameter of the core 4 is preferably not greater than 42.0 mm and particularly preferably not greater than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin or together with an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably not less than 0.2 mm and particularly preferably not less than 0.3 mm. The thickness of the mid layer 6 is preferably not greater than 2.5 mm and particularly preferably not greater than 2.2 mm. The mid layer 6 has a specific gravity of preferably not less than 0.90 and particularly preferably not less than 0.95. The specific gravity of the mid layer 6 is preferably not greater than 1.10 and particularly preferably not greater than 1.05. The mid layer 6 may have two or more layers.

The cover 8 is formed from a thermoplastic resin composition, a thermosetting resin composition, or a mixture of both compositions. Preferably, the cover 8 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 having the cover 8 that includes an ionomer resin has excellent resilience performance. The golf ball 2 has excellent flight distance upon a shot with a driver. The ionomer resin described above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 80% by weight.

The resin composition of the cover 8 may include a pigment. The resin composition can include an inorganic pigment and an organic pigment. Examples of the inorganic pigment include: red pigments such as iron oxide red ($Fe_2O_3$), red lead ($Pb_3O_4$), molybdenum red, and cadmium red; yellow pigments such as titanium yellow ($TiO_2$—$NiO$—$Sb_2O_3$) litharge ($PbO$), chrome yellow ($PbCrO_4$), yellow iron oxide ($FeO(OH)$), and cadmium yellow; and blue pigments such as cobalt blue ($CoO.Al_2O_3$), Prussian blue, and ultramarine blue. Examples of the organic pigment include azo pigments, phthalocyanine pigments, and perylene pigments. Azo pigments are preferable. Examples of azo pigments include pigment yellow 1, pigment yellow 12, pigment red 3, pigment red 57, and pigment orange 13.

The resin composition of the cover 8 may include a filler, a dispersant, an antioxidant, an ultraviolet absorber, a light stabilizer, a fluorescent material, a fluorescent brightener, and the like in an adequate amount.

The cover 8 has a thickness of preferably not less than 0.2 mm and particularly preferably not less than 0.3 mm. The thickness of the cover 8 is preferably not greater than 2.5 mm and particularly preferably not greater than 2.2 mm. The cover 8 has a specific gravity of preferably not less than 0.90 and particularly preferably not less than 0.95. The specific gravity of the cover 8 is preferably not greater than 1.10 and particularly preferably not greater than 1.05. The cover 8 may have two or more layers.

Figure 2:
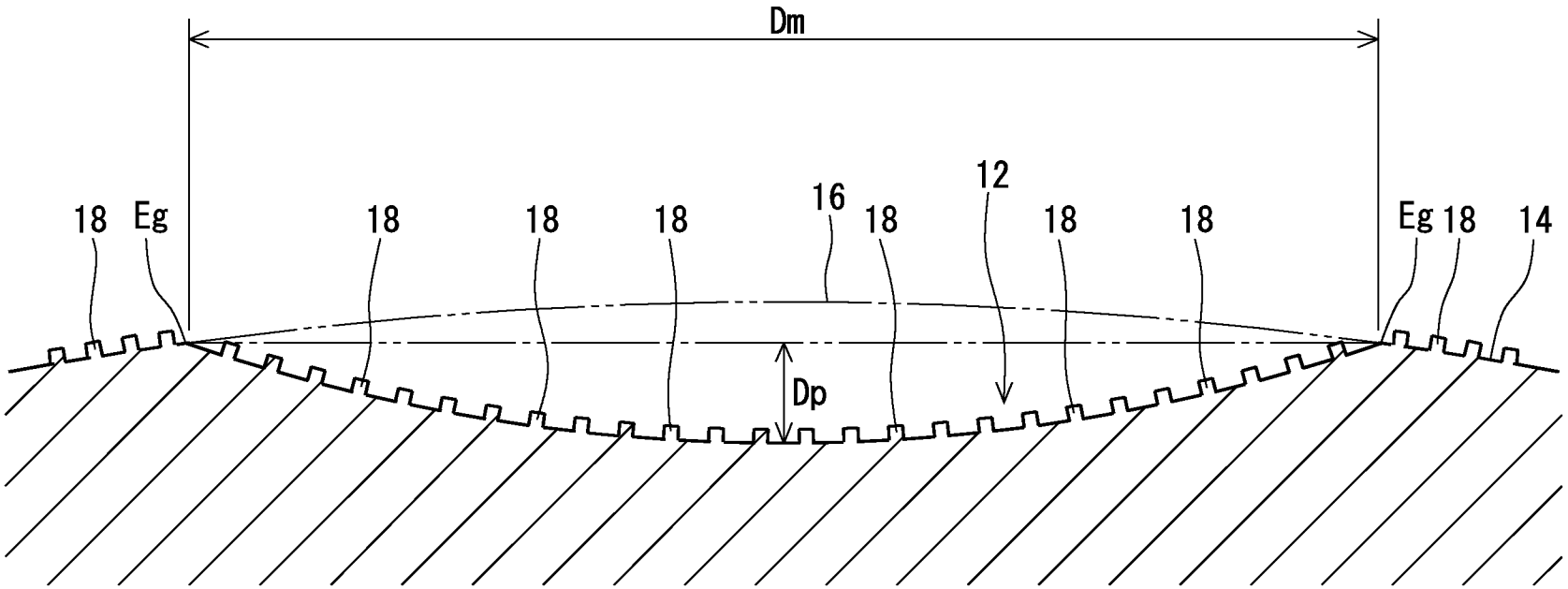
FIG. 2 is a partially enlarged cross-sectional view of the golf ball in FIG. 1.

FIG. 2 shows a cross section of the golf ball 2 along a plane passing through the central point of a dimple 12 and the central point of the golf ball 2. In FIG. 2, the top-to-bottom direction is the depth direction of the dimple 12. In FIG. 2, an alternate long and two short dashes line 16 indicates a phantom sphere. The surface of the phantom sphere 16 is the surface of the golf ball 2 when it is postulated that no dimple 12 and no exposed portion (described in detail later) exist. The diameter of the phantom sphere 16 is equal to the diameter of the golf ball 2. The dimple 12 is recessed from the surface of the phantom sphere 16. The land 14 coincides with the surface of the phantom sphere 16.

In FIG. 2, an arrow Dm indicates the diameter of the dimple 12. The diameter Dm is the distance between two tangent points Eg appearing on a tangent line Tg that is drawn tangent to the far opposite ends of the dimple 12. Each tangent point Eg is also the edge of the dimple 12. The edge Eg defines the contour of the dimple 12.

The diameter Dm of each dimple 12 is preferably not less than 2.0 mm and not greater than 6.0 mm. The dimple 12 having a diameter Dm of not less than 2.0 mm contributes to turbulization. From this viewpoint, the diameter Dm is more preferably not less than 2.5 mm and particularly preferably not less than 2.8 mm. The dimple 12 having a diameter Dm of not greater than 6.0 mm does not impair a fundamental feature of the golf ball 2 being substantially a sphere. From this viewpoint, the diameter Dm is more preferably not greater than 5.5 mm and particularly preferably not greater than 5.0 mm.

In the case of a non-circular dimple, a circular dimple 12 having the same area as that of the non-circular dimple is assumed. The diameter of the assumed dimple 12 can be regarded as the diameter of the non-circular dimple.

In FIG. 2, a double ended arrow Dp indicates the depth of the dimple 12. The depth Dp is the distance between the deepest part of the dimple 12 and the tangent line Tg. An average depth Dpav is calculated by summing the depths Dp of all the dimples 12 and dividing the sum of the depths Dp by the total number of the dimples 12. The average depth Dpav is preferably not less than 80 μm and not greater than 200 μm. With the golf ball 2 in which the average depth Dpav is not less than 80 μm, a large run can be achieved. From this viewpoint, the average depth Dpav is more preferably not less than 100 μm and particularly preferably not less than 110 μm. With the golf ball 2 in which the average depth Dpav is not greater than 200 μm, a large carry can be achieved. From this viewpoint, the average depth Dpav is more preferably not greater than 180 μm and particularly preferably not greater than 160 μm.

Figure 3:
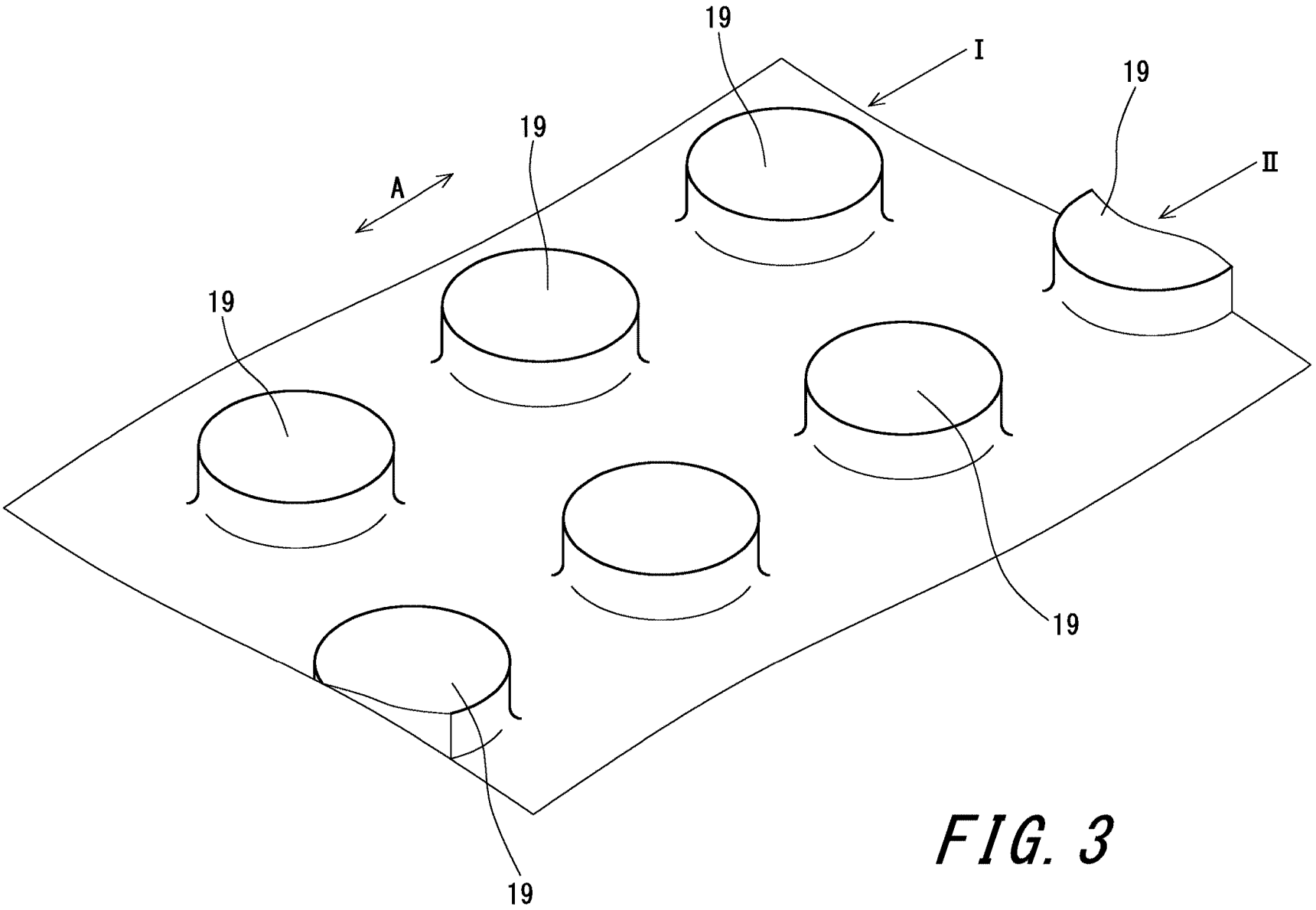
FIG. 3 is a partially enlarged perspective view of the surface of the golf ball in FIG. 1.

FIG. 3 is a partially enlarged perspective view of the surface of the golf ball 2 in FIG. 1. As described above, the golf ball 2 does not have a paint layer. Therefore, the surface of the cover 8 is the surface of the golf ball 2 shown in FIG. 3. As shown in FIG. 3, the cover 8 has a large number of minute projections 18 on the surface thereof. Each minute projection 18 generally has a cylindrical shape. As is obvious from FIG. 2, the minute projections 18 are formed on the surfaces of the dimples 12 and also on the surface of the land 14. Each minute projection 18 stands outward in the radial direction of the golf ball 2. The minute projections 18 may be formed only on the surfaces of the dimples 12. The minute projections 18 may be formed only on the surface of the land 14. Since a paint layer is not included, each minute projection 18 is exposed on the surface of the golf ball 2 as a whole. In the golf ball 2 that does not have a paint layer, the minute projection 18 is also an exposed portion 19 as a whole.

When the golf ball 2 collides against the ground or rolls on the ground, mud may be brought into contact with the surface of the golf ball 2. The mud flows between an exposed portion 19 and another exposed portion 19 adjacent to this exposed portion 19 as a flow passage. Thus, the mud is less likely to adhere to the golf ball 2. The golf ball 2 is less likely to become stained. The golf ball 2 has excellent stain resistance.

Water easily flows between an exposed portion 19 and another exposed portion 19 adjacent to this exposed portion 19. Therefore, even if mud adheres to the surface of the golf ball 2, when the golf ball 2 is washed with water, the water flows while taking in the dirt. Dirt is easily removed from the golf ball 2. The golf ball 2 has excellent washability. The exposed portions 19 can also contribute to protection of a mark layer.

As described above, the golf ball 2 does not have a paint layer. Therefore, improvement of a spin rate due to a paint layer cannot be expected. However, the coefficient of friction of the golf ball 2, which has the exposed portions 19, against a clubface is high, and thus a significant reduction in spin rate does not occur as compared to a conventional golf ball. The golf ball 2 has excellent flight performance upon a shot with a long iron.

FIG. 3 shows a plurality of exposed portions 19 belonging to a first row I, and a plurality of exposed portions 19 belonging to a second row II. The direction indicated by an arrow A in FIG. 3 is the direction in which the rows extend. In each row, the exposed portions 19 are aligned at equal pitches. In other words, the exposed portions 19 are regularly aligned. The exposed portions 19 belonging to the first row I and the exposed portions 19 belonging to the second row II are arranged in a zigzag manner. At a part of the surface of the golf ball 2, the exposed portions 19 may be irregularly aligned.

Figure 4:
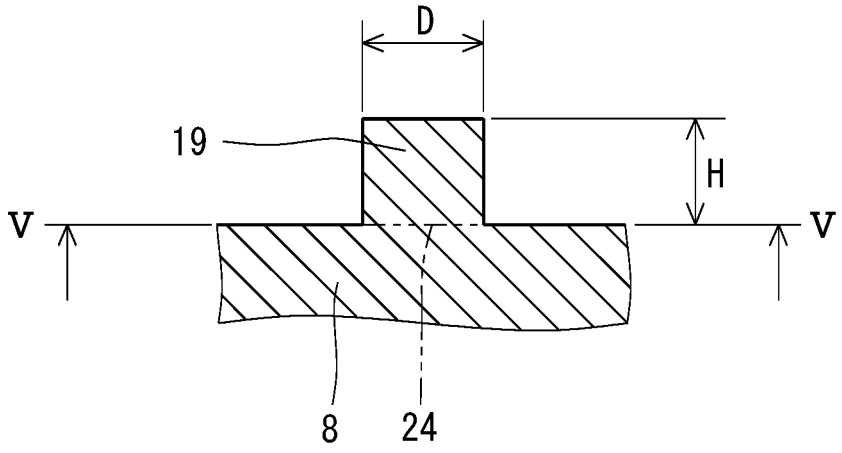
FIG. 4 is a partially enlarged cross-sectional view of the golf ball in FIG. 1.

FIG. 4 is a partially enlarged cross-sectional view of the golf ball 2 in FIG. 1. The cover 8 has the minute projections 18 (that is, the exposed portions 19). The exposed portions 19 stand outward in the radial direction of the golf ball 2. In FIG. 4, reference sign 24 indicates the bottom surface of the exposed portion 19.

Figure 5:
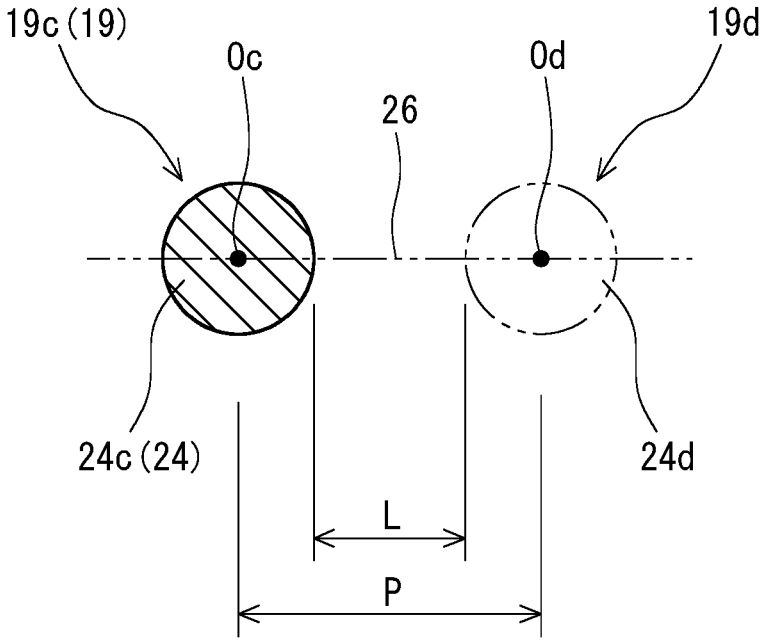
FIG. 5 is a cross-sectional view taken along the line V-V in FIG. 4.

FIG. 5 is a cross-sectional view taken along the line V-V in FIG. 4. FIG. 5 shows the bottom surface 24 of the exposed portion 19. As described above, each minute projection 18 has a cylindrical shape. Therefore, the shape of the bottom surface 24 of the exposed portion 19 is a circle.

In FIG. 4, an arrow D indicates the diameter of the bottom surface 24 and indicates the diameter of the exposed portion 19. An average diameter Day is calculated by summing the diameters D of all the exposed portions 19 and dividing the sum of the diameters D by the number of the exposed portions 19. The average diameter Dav is preferably not less than 5 μm and not greater than 50 μm. The golf ball 2 in which the average diameter Dav is in the above range has excellent stain resistance and washability. The golf ball 2 in which the average diameter Dav is in the above range has excellent flight distance upon a shot with a long iron. From these viewpoints, the average diameter Dav is more preferably not less than 15 μm and particularly preferably not less than 20 μm. From the same viewpoints, the average diameter Day is more preferably not greater than 40 μm and particularly preferably not greater than 35 μm.

The area of each exposed portion 19 is defined as the area of the bottom surface 24. The area Sp of the exposed portion 19 shown in FIGS. 4 and 5 can be calculated by the following mathematical formula.

$$Sp=(D/2)^2*\pi$$

The ratio Pp of the sum of the areas Sp of all the exposed portions 19 to the surface area of the phantom sphere 16 of the golf ball 2 is preferably not less than 7%. The golf ball 2 in which the ratio Pp is not less than 7% has excellent stain resistance and washability. The golf ball 2 further has excellent flight distance upon a shot with a long iron. From these viewpoints, the ratio Pp is preferably not less than 15% and particularly preferably not less than 20%. In light of ease of production of a mold for the golf ball 2, the ratio Pp is preferably not greater than 50%, more preferably not greater than 40%, and particularly preferably not greater than 35%.

FIG. 5 shows a bottom surface 24*c* of a first exposed portion 19*c* and also shows a bottom surface 24*d* of a second exposed portion 19*d* by an alternate long and two short dashes line. The second exposed portion 19*d* is adjacent to the first exposed portion 19*c*. In FIG. 5, an alternate long and two short dashes line 26 represents a straight line passing through the center of gravity Oc of the bottom surface 24*c* of the first exposed portion 19*c* and the center of gravity Od of the bottom surface 24*d* of the second exposed portion 19*d*.

In FIG. 5, an arrow P indicates a pitch. The pitch P is the distance between the first exposed portion 19*c* and the second exposed portion 19*d* adjacent to the first exposed portion 19*c*. The pitch P is the distance between the center of gravity Oc of the bottom surface 24*c* of the first exposed portion 19*c* and the center of gravity Od of the bottom surface 24*d* of the second exposed portion 19*d*. The "second exposed portion 19*d* adjacent to the first exposed portion 19*c*" is the exposed portion 19*d* having a smallest distance L (described in detail later) to the first exposed portion 19*c*, among the exposed portions 19 present around the first exposed portion 19*c*.

For each exposed portion 19, one pitch P is determined. An average pitch Pav is calculated by summing the pitches P of all the exposed portions 19 and dividing the sum of the pitches P by the number of the exposed portions 19. The average pitch Pav is preferably not greater than 100 μm. The golf ball 2 in which the average pitch Pav is not greater than 100 μm has excellent stain resistance, washability, and flight performance upon a shot with a long iron. From these viewpoints, the average pitch Pav is more preferably not greater than 80 μm and particularly preferably not greater than 70 μm. From the same viewpoints, the average pitch Pav is preferably not less than 10 μm, more preferably not less than 20 μm, and particularly preferably not less than 25 μm.

In FIG. 5, an arrow L indicates the distance between the first exposed portion 19*c* and the second exposed portion 19*d* adjacent to the first exposed portion 19*c*. The distance L is a value obtained by subtracting the radius of the bottom surface 24*c* of the first exposed portion 19*c* and the radius of the bottom surface 24*d* of the second exposed portion 19*d* from the pitch P. For each exposed portion 19, one distance L is determined. An average distance Lav is calculated by summing the distances L of all the exposed portions 19 and dividing the sum of the distances L by the number of the exposed portions 19. The average distance Lav is preferably not less than 5 μm and not greater than 50 μm. The golf ball 2 in which the average distance Lav is in this range has excellent stain resistance, washability, and flight performance upon a shot with a long iron. From these viewpoints, the average distance Lav is particularly preferably not less than 10 μm and not greater than 40 μm.

In FIG. 4, an arrow H indicates the height of the minute projection 18 and indicates the height of the exposed portion 19. The height H is measured along the radial direction of the golf ball 2. An average height Hav is calculated by summing the heights H of all the exposed portions 19 and dividing the sum of the heights H by the number of the exposed portions 19. The average height Hav is preferably not less than 0.5 μm and not greater than 50 μm. The golf ball 2 in which the average height Hav is in this range has excellent stain resistance, washability, and flight performance upon a shot with a long iron. From these viewpoints, the average height Hav is preferably not less than 2 μm and particularly preferably not less than 3 μm. From the same viewpoints, the average height Hav is more preferably not greater than 40 μm and particularly preferably not greater than 35 μm.

The total number of the exposed portions 19 is preferably not less than 10 thousand and not greater than 10 million. The golf ball 2 in which this total number is not less than 10 thousand has excellent stain resistance, washability, and flight performance upon a shot with a long iron. From these viewpoints, this total number is more preferably not less than 20 thousand and particularly preferably not less than 50 thousand. A mold for the golf ball 2 in which this total number is not greater than 10 million is easily produced. From this viewpoint, this total number is more preferably not greater than 7 million and particularly preferably not greater than 5 million.

The surface of the golf ball 2 preferably has an arithmetic average height Sa of not less than 0.5 μm and not greater than 30 μm. The golf ball 2 in which the arithmetic average height Sa is in this range has excellent stain resistance, washability, and flight performance upon a shot with a long iron. From these viewpoints, the arithmetic average height Sa is more preferably not less than 1.5 μm and particularly preferably not less than 2.0 μm. From the same viewpoints, the arithmetic average height Sa is more preferably not greater than 25 μm and particularly preferably not greater than 20 μm.

The surface of the golf ball 2 preferably has a maximum height Sz of not less than 5 μm and not greater than 200 μm. The golf ball 2 in which the maximum height Sz is in this range has excellent stain resistance, washability, and flight performance upon a shot with a long iron. From these viewpoints, the maximum height Sz is more preferably not less than 10 μm and particularly preferably not less than 15 μm. From the same viewpoints, the maximum height Sz is more preferably not greater than 180 μm and particularly preferably not greater than 160 μm.

The arithmetic average height Sa and the maximum height Sz are measured according to the standards of ISO-25178 with a laser microscope (for example, a non-contact type surface roughness/shape measuring instrument of Keyence Corporation). In the microscope, the surface of the golf ball 2 is scanned with a laser in an X direction and a Y direction. Through this scanning, unevenness data of the surface of the golf ball 2 is obtained. The arithmetic average height Sa and the maximum height Sz are calculated on the basis of a three-dimensional image obtained from the unevenness data. The measurement conditions are as follows.

Magnification: 1000
Measurement range X: 250 μm
Measurement range Y: 250 μm
Cutoff value: λc=0.25
Observation region: X=1024 pixels, Y=768 pixels
Total number of pixels: 786432 pixels The glossiness of the surface of the golf ball 2 is preferably not less than 0.1 and not greater than 20. The golf ball 2 in which the glossiness is in this range has excellent appearance. From this viewpoint, the glossiness is more preferably not less than 0.3 and not greater than 17, and particularly preferably not less than 0.5 and not greater than 15. The glossiness is measured according to the standards of "ASTM D523-60°".

Figure 6:
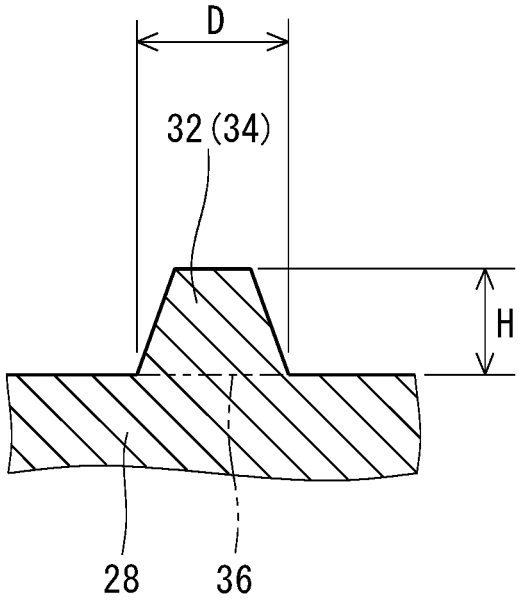
FIG. 6 is a cross-sectional view of a part of a golf ball according to another embodiment of the present invention.

FIG. 6 is a cross-sectional view of a part of a golf ball according to another embodiment of the present invention. FIG. 6 shows a cover 28 that is a part of a main body. The cover 28 has minute projections 32. This golf ball does not have a paint layer. Therefore, each minute projection 32 is an exposed portion 34 as a whole. In FIG. 6, reference sign 36 indicates the bottom surface of the exposed portion 34.

Each minute projection 32 has a truncated cone shape. Therefore, each exposed portion 34 also has a truncated cone shape. The specifications of this golf ball excluding the shape of the minute projection 32 (that is, the shape of the exposed portion 34) are the same as the specifications of the golf ball 2 shown in FIGS. 1 to 5.

In this golf ball as well, the exposed portions 34 contribute to stain resistance, washability, and flight performance upon a shot with a long iron.

Figure 7:
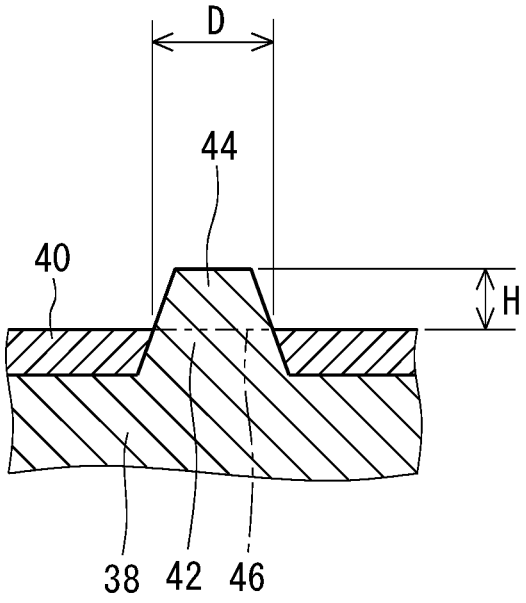
FIG. 7 is a cross-sectional view of a part of a golf ball according to still another embodiment of the present invention.

FIG. 7 is a cross-sectional view of a part of a golf ball according to still another embodiment of the present invention. This golf ball has a cover 38 and a paint layer 40. The cover 38 has minute projections 42. The paint layer 40 is thin. Therefore, a part of each minute projection 42 is not covered with the paint layer 40. In other words, a part of each minute projection 42 is exposed on the surface of the golf ball. This part is referred to as an exposed portion 44. The exposed portion 44 projects from the paint layer 40. In FIG. 7, reference sign 46 indicates the bottom surface of the exposed portion 44.

In this golf ball as well, the exposed portions 44 have excellent stain resistance, washability, and flight performance upon a shot with a long iron.

The golf ball may have minute projections having a shape such as a cone shape, a prism shape, a truncated pyramid shape, a pyramid shape, a partial sphere shape, and the like.

EXAMPLES

Example 1

A rubber composition was obtained by kneading 100 parts by weight of a high-cis polybutadiene (trade name "BR-730", manufactured by JSR Corporation), 27.4 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. This rubber composition was placed into a mold including upper and lower mold halves each having a hemispherical cavity, and heated at 160° C. for 20 minutes to obtain a core with a diameter of 38.20 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "Rabalon T3221C", manufactured by Mitsubishi Chemical Corporation), 4 parts by weight of titanium dioxide (A220), and 0.2 parts by weight of a light stabilizer (trade name "JF-90", manufactured by Johoku Chemical Co., Ltd.) with a twin-screw kneading extruder. The core was covered with this resin composition by injection molding to form a mid layer. The thickness of the mid layer was 1.00 mm.

A resin composition was obtained by kneading 47 parts by weight of an ionomer resin (trade name "Himilan 1555", manufactured by Du Pont-MITSUI POLYCHEMICALS Co., Ltd.), 46 parts by weight of another ionomer resin (trade name "Himilan 1557", manufactured by Du Pont-MITSUI POLYCHEMICALS Co., Ltd.), 7 parts by weight of a styrene block-containing thermoplastic elastomer (the aforementioned "Rabalon T3221C"), 4 parts by weight of titanium dioxide (A220), and 0.2 parts by weight of a light stabilizer (the aforementioned "JF-90") with a twin-screw kneading extruder. The sphere consisting of the core and the mid layer was placed into a final mold having a large number of pimples and minute recesses on its cavity face. The mid layer was covered with the resin composition by injection molding to form a cover. The thickness of the cover was 1.25 mm. Dimples having a shape that is the inverted shape of the pimples were formed on the cover. Furthermore, minute projections (exposed portions) having a shape that is the inverted shape of the minute recesses were formed on the cover.

Examples 2 to 8 and Comparative Examples 1 and 3

Golf balls of Examples 2 to 8 and Comparative Examples 1 and 3 were obtained in the same manner as Example 1, except the final mold was changed and exposed portions having specifications shown in Tables 1 to 3 below were formed. The golf ball according to Comparative Example 3 does not have any exposed portions.

Comparative Example 2

A golf ball of Comparative Example 2 was obtained in the same manner as Comparative Example 3, except the entirety of the cover was covered with a paint layer. The thickness of the paint layer was 10 μm.

[Spin Rate]

An iron club #5 (trade name "SRIXON", manufactured by Sumitomo Rubber Industries, Ltd., shaft hardness: S) was attached to a swing machine manufactured by Golf Laboratories, Inc. A golf ball was hit under a condition of a head speed of 41 m/sec, and the spin rate was measured. The average value of data obtained by 20 measurements is shown in Tables 1 to 3 below. A ratio of the spin rate obtained with the value of Comparative Example 2 being used as a reference is also shown in Tables 1 to 3 below.

[Stain Resistance]

The golf balls according to each Example and each Comparative Example were put into a bucket together with soil, and the soil was agitated. Thereafter, the degree of stain of each golf ball was categorized on the basis of the following criteria.

A: Stain is very little
B: Stain is little

C: Stain is much

D: Stain is very much

The results are shown in Tables 1 to 3 below.

[Washability]

The golf balls that had been evaluated for stain resistance were put into a bucket together with water, and the water was agitated. Thereafter, the degree of stain of each golf ball was categorized on the basis of the following criteria.

A: Stain is very little

B: Stain is little

C: Stain is much

D: Stain is very much

The results are shown in Tables 1 to 3 below.

TABLE 1

| | Example 2 | Example 3 | Example 1 | Example 4 |
|---|---|---|---|---|
| Dav (μm) | 15 | 25 | 25 | 25 |
| Pav (μm) | 30 | 50 | 50 | 50 |
| Pp (%) | 22.7 | 22.7 | 22.7 | 22.7 |
| Hav (μm) | 10 | 5 | 10 | 30 |
| Paint layer | Absent | Absent | Absent | Absent |
| Sa (μm) | 5 | 2.5 | 5 | 15 |
| Sz (μm) | 50 | 25 | 50 | 150 |
| Stain resistance | B | B | A | B |
| Washability | B | A | A | A |
| Spin (rpm) | 4675 | 4625 | 4650 | 4675 |
| Spin (%) | 99.5 | 98.4 | 98.9 | 99.5 |

TABLE 2

| | Compa. Example 1 | Example 5 | Example 6 | Example 7 |
|---|---|---|---|---|
| Dav (μm) | 25 | 25 | 40 | 25 |
| Pav (μm) | 50 | 75 | 80 | 95 |
| Pp (%) | 22.7 | 10.1 | 22.7 | 6.3 |
| Hav (μm) | 55 | 10 | 10 | 10 |
| Paint layer | Absent | Absent | Absent | Absent |
| Sa (μm) | 27.5 | 5 | 5 | 5 |
| Sz (μm) | 275 | 50 | 50 | 50 |
| Stain resistance | C | A | B | B |
| Washability | C | B | B | C |
| Spin (rpm) | 4700 | 4625 | 4600 | 4575 |
| Spin (%) | 100.0 | 98.4 | 97.9 | 97.3 |

TABLE 3

| | Example 8 | Compa. Example 2 | Compa. Example 3 |
|---|---|---|---|
| Dav (μm) | 60 | — | — |
| Pav (μm) | 120 | — | — |
| Pp (%) | 22.7 | 0 | 0 |
| Hav (μm) | 10 | — | — |
| Paint layer | Absent | Present | Absent |
| Sa (μm) | 5 | — | — |
| Sz (μm) | 50 | — | — |
| Stain resistance | D | D | E |
| Washability | C | D | E |

TABLE 3-continued

| | Example 8 | Compa. Example 2 | Compa. Example 3 |
|---|---|---|---|
| Spin (rpm) | 4525 | 4700 | 4500 |
| Spin (%) | 96.3 | — | 95.7 |

As shown in Tables 1 to 3, the golf ball of each Example has excellent flight performance upon a shot with a long iron. Furthermore, the golf ball of each Example has excellent stain resistance and washability. From the evaluation results, advantages of the present invention are clear.

The aforementioned minute projections are applicable to golf balls having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball comprising a core and a cover positioned outside the core, wherein the cover has a plurality of minute projections on a surface thereof, each minute projection has an exposed portion that is exposed on a surface of the golf ball, the surface of the golf ball has an arithmetic average height Sa of not less than 0.5 μm and not greater than 30 μm, and an average value Hay of heights H of the exposed portions is not less than 2 μm and not greater than 50 μm, wherein the arithmetic average height Sa is based on a three-dimensional image obtained from a laser microscope scanning of the golf ball surface to generate unevenness data and corresponds to the average height of the surface of the golf ball as measured according to the standards of ISO-25178.

2. The golf ball according to claim 1, wherein a ratio Pp of a sum of areas of all the exposed portions to a surface area of a phantom sphere of the golf ball is not less than 7%.

3. The golf ball according to claim 1, wherein an average value Day of diameters D of the exposed portions is not less than 5 μm and not greater than 50 μm.

4. The golf ball according to claim 1, wherein an average value Pay of pitches P each between an exposed portion and another exposed portion adjacent to this exposed portion is not greater than 100 μm.

5. The golf ball according to claim 1, wherein the surface of the golf ball has a maximum height Sz of not less than 5 μm and not greater than 200 μm.

6. The golf ball according to claim 1, further comprising a paint layer partially covering the cover, wherein the exposed portions project from the paint layer.

7. The golf ball according to claim 5, wherein the maximum height Sz is based on a three-dimensional image obtained from a laser microscope scanning of the golf ball surface to generate unevenness data and corresponds to the average height of the surface of the golf ball as measured according to the standards of ISO-25178.

* * * * *